United States Patent [19]

de Polo

[11] 4,176,408

[45] Dec. 4, 1979

[54] GARMENTS FORMED OF HELICALLY COILED PIECES

[76] Inventor: Harry R. de Polo, 480 Park Ave., New York, N.Y. 10022

[21] Appl. No.: 921,180

[22] Filed: Jul. 3, 1978

Related U.S. Application Data

[63] Continuation-in-part of Ser. No. 770,034, Feb. 18, 1977, Pat. No. 4,097,933.

[51] Int. Cl.[2] ..... A41D 7/00

[52] U.S. Cl. ..... 2/69; 2/67; 2/227

[58] Field of Search ..... 2/67, 69, 243 B, 227, 2/228, 238, 243 R, 74

[56] References Cited

U.S. PATENT DOCUMENTS

| | | | |
|---|---|---|---|
| 3,704,469 | 12/1972 | Levy | 2/69 |
| 3,877,079 | 4/1975 | O'Bryant | 2/227 |

*Primary Examiner*—Doris L. Troutman

*Attorney, Agent, or Firm*—Robert E. Burns; Emmanuel J. Lobato; Bruce L. Adams

[57] ABSTRACT

A body-type garment, i.e. a garment intended to cover at least a portion of the torso of the wearer comprises a strip of material having generally parallel side edges and inclined end edges defining at least approximately a parallelogram shape. String passages, for example a hem or fold, extend at least along the side edges of the strip. The strip is coiled into helical form about the body of the wearer with side edges of adjacent convolutions of the strip adjacent one another. String extending through the string passages is drawn taut and secured so as to hold the side edges of adjacent convolutions adjacent one another. A pants-type garment comprising a body portion and two leg portions extending downward from the body portion has each leg and an associated portion of the body portion made from a strip of material likewise having side edges and inclined helical edges defining at least approximately a parallelogram. Each of the strips is coiled into helical form to form a leg of the garment while upper end portions of the strips are shaped and joined so as to form the body portion. String extending through string passages along at least side edges of the strip are pulled taut and secured so as to hold the side edges of adjacent convolutions of the strip together.

11 Claims, 8 Drawing Figures

GARMENTS FORMED OF HELICALLY COILED PIECES

REFERENCE TO PRIOR APPLICATION

This application is a continuation-in-part of my application Ser. No. 770,034 filed Feb. 18, 1977 now U.S. Pat. No. 4,097,933 issued July 4, 1978.

FIELD OF INVENTION

The present invention relates to the construction of body-type and pants-type garments. The term "body-type garment" is used broadly to include dresses, slips, blouses, coats, jackets, nightgowns, hostess coats, skirts, bathing suits, undergarments and other garments which cover or partially cover the torso and in some cases also the legs of a wearer. The term "pants-type garment" is used broadly to include pants, slacks, jeans, culottes, shorts and similar garments for covering the lower portion of the torso and individually covering at least partially the legs of a wearer.

BACKGROUND OF THE INVENTION

Dress-type garments and pants-type garments have heretofore been made by using a pattern to cut pieces of various sizes and shapes from fabric material and then sewing the pieces together. Frequently it is necessary to use pleats, darts, shirring or gathering in order to obtain a garment of the desired shape. As considerable skill and experience is required, a relatively small number of individuals are capable of making their own clothes. By reason of the time, skill and labor involved, it has become more and more expensive to have clothes made by a professional dressmaker. Even by mass production methods, the labor involved in cutting and assembling garments made by conventional methods has greatly increased the cost of clothing.

SUMMARY OF THE INVENTION

It is an object of the present invention to overcome the disadvantages of the prior art by providing a novel type of construction which greatly simplifies the work involved in making a garment. Instead of being formed of numerous pieces of fabric cut according to pattern and then sewn together, a garment in accordance with the present invention is formed of one or more long strips wound in a helical manner about the torso of the wearer and secured to prevent unwinding. The construction in accordance with the present invention thus simplifies not only the cutting of the fabric but also its assembly into a garment. In its simplest form a body-type garment in accordance with the present invention (apart from any sleeves or trimming) consists of a single strip of material which is wound helically and secured so as to maintain the helical structure. If desired, two or more strips can first be joined edge-to-edge by continuous seams whereupon the composite strip thus formed is wound into a helix.

In the case of pants-type garments comprising a body portion which covers the lower portion of the torso of a wearer and leg portions extending downwardly from the body portion, each of the leg portions is formed of a strip of material wound helically about the leg. Upper portions of the strips are shaped and joined so as to provide the body portion of the garment.

In accordance with the present invention the strips of material which are to be coiled helically have approximately parallel side edges and inclined end edges defining at least approximately a parallelogram shape. String passages extending at least along the side edges of the strip are formed, for example by folds or hems. String extending through the string passages are pulled taut and secured so as to hold side edges of adjacent convolutions of the helically wound strips adjacent one another. The term "string" is herein used in a generic sense to include string, cord, ribbon, yarn, filament, chain, or other elongated flexible element.

In addition to simplifying the construction of garments, the present invention makes possible the production of garments of novel style and attractive appearance. The helical construction in itself imparts a distinctive appearance to the garment. In contrast with conventional garments in which junction lines run either horizontally or vertical, the lines of garments made in accordance with the present invention run helically. Moreover, if the garment is made of two or more long strips of material, the strips can be of different fabrics or different patterns or textures thereby highlighting the effect created by the helical construction.

BRIEF DESCRIPTION OF DRAWINGS

The nature, objects and advantages of the invention will be more fully understood from the following description of preferred embodiments as shown schematically by way of example in the accompanying drawings in which.

DESCRIPTION OF PREFERRED EMBODIMENTS

Figure 1:
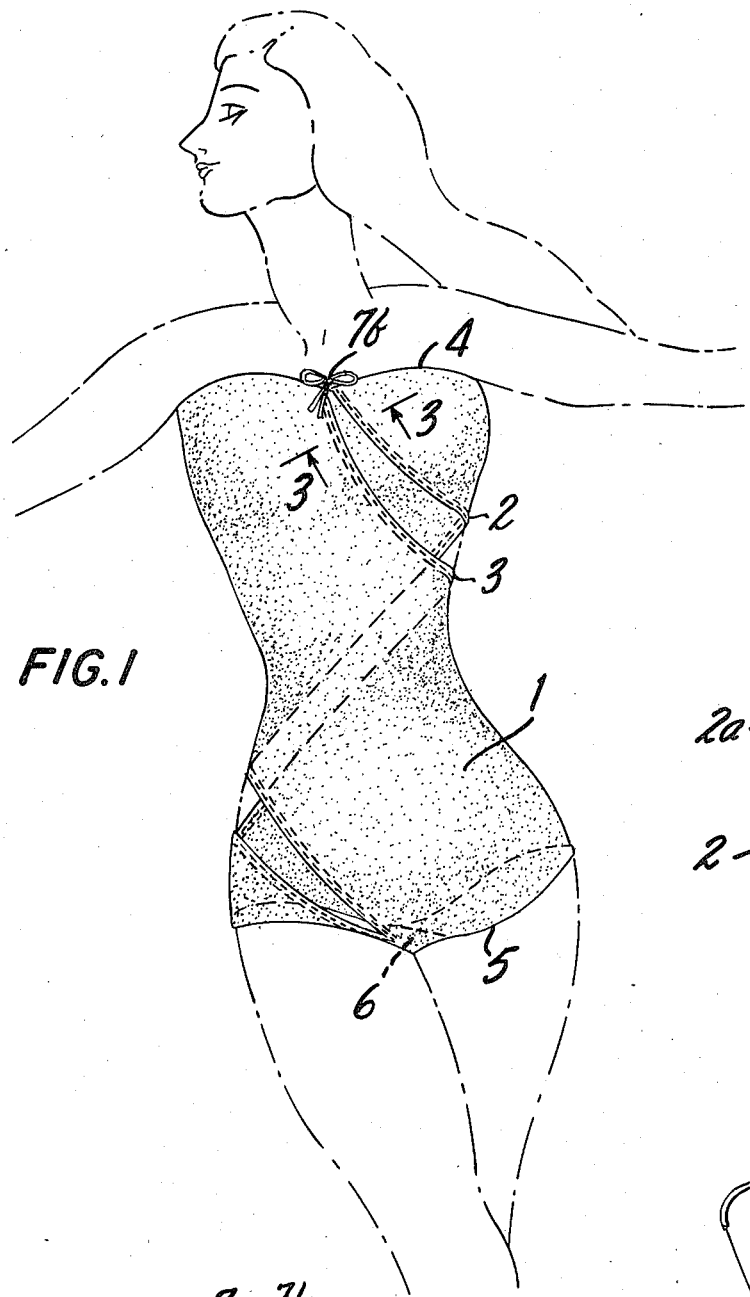
FIG. 1 shows a body-type garment suitable for use, for example as a bathing suit or undergarment.
Figure 2:
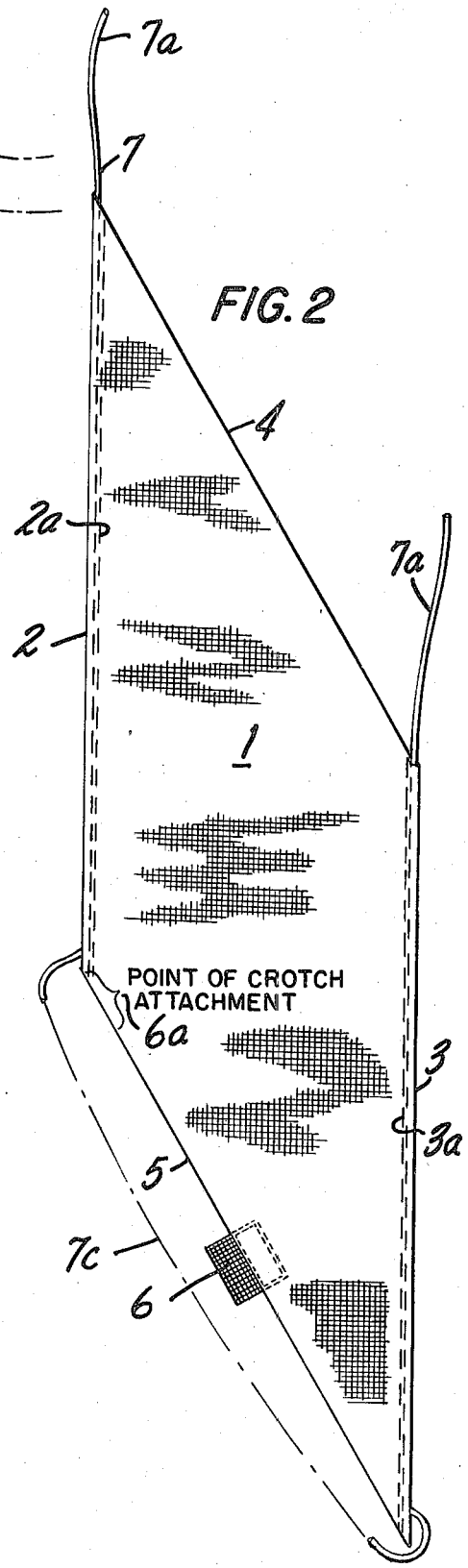
FIG. 2 shows a strip of material of which the garment of FIG. 1 is made.
Figure 3:
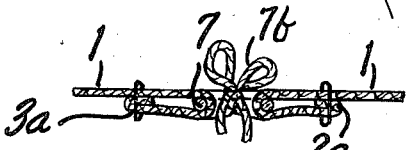
FIG. 3 is a partial sectional view taken approximately on the line 3—3 in FIG. 1 showing side edges of the strip provided with string passages in the form of hems.

In FIG. 1 there is shown schematically a body-type garment made in accordance with the present invention while FIG. 2 shows the strip of material of which the garment is made. The garment is shown as a bathing suit but is of a type that might be used as an undergarment or might be used as a shirt or blouse to be worn, for example with a skirt or slacks. The garment is made of the single strip of material 1 shown in FIG. 2. The strip is shown as having parallel side edges 2 and 3 and upper and lower end edges 4 and 5 which are inclined to the side edges so as to form at least approximately a parallelogram. Along the side edges 2 and 3 there are provided string passages which are shown in the form of hems 2*a* and 3*a*. Upper and lower edges 4 and 5 are suitably finished, for example by rolling, hemming or binding. At approximately the midpoint of the lower edge 5 there is provided a small piece or portion of material 6 which is to form the crotch of the garment. In the completed garment the crotch piece 6 is secured to a portion of the lower edge 5 which is identified in the drawing by the reference numeral 6a. A string 7 extends through the string passage 2a along the side edge 2 of the material from the upper end edge 4 to the lower end edge 5 and then extends up through the string passage 3a along side edge 3 of the strip from the lower edge 5 to the upper edge 4. Opposite end portions 7a of the string 7 extend beyond the upper edge of the strip. The dotted line 7c is intended to indicate continuity of the string from the lower end of string passage 2a at side edge 2 of the strip to the lower end of string passageway 3a at the side edge 3 of the strip.

The garment shown in FIG. 1 is formed from the single strip of material shown in FIG. 2 by coiling the strip of material into helical form so that side edges 2 and 3 are adjacent one another. The crotch piece 6 is secured to the lower edge 5 of the strip at the location designated 6a and forms the crotch portion of the garment. When the garment is worn, the string 7 is pulled taut by the extending end portions 7a which are thereupon tied together, for example in a bow knot 7b as illustrated in FIG. 1. The side edges 2 and 3 of the strip 1 are thereby held adjacent one another although as illustrated in FIG. 1 they may be spaced slightly so as to provide a "see-through" effect. The upper edge 4 of the strip forms the upper edge of the garment while the lower edge 5 of the strip forms the lower edge of the garment. It will be seen that the garment is highly attractive and yet is of extremely simple construction.

Figure 4:
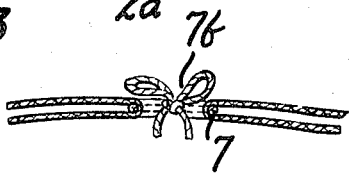
FIG. 4 is a fragmentary section similar to FIG. 3 but illustrating straight passages provided by side folds of flattened tubular material constituting the strip from which the garment is made.

The strip 1 of which the garment is made can be of any material which is suitable for the intended purpose of the garment. Thus it may be of knitted, netted, woven or unwoven material of any desired fiber content. Moreover, instead of single thickness material, it may be made of two or more plies. For example when the garment is to be worn as underwear, a layer of thermal material may be sandwiched between inner and outer layers of material to give greater warmth. The strip may also be in the form of a flattened tube in which event the folds at the sides provide string passages, as illustrated in FIG. 4, without the need of hemming. The tube may for example be of seamless tubular knitted fabric which has the advantage that it can be produced rapidly and economically by circular knitting machines and the further advantage that it can have any desired degree of one-way or two-way stretch. The tube may also be made by coiling a strip of material helically and joining contiguous edges of adjacent convolutions of the strip as described in my application Ser. No. 921,181 filed simultaneously herewith. The tube thus formed is then flattened and used as the strip 1 of which the garment is made as described above.

The strip 1 may also be made as a composite strip by joining two or more narrower strips, for example by continuous seams as illustrated in my above mentioned patent no.

The width of the strip 1 is such as to give a spiral effect such as that illustrated in FIG. 1 in which the strip makes approximately one complete revolution in the distance from the arms of the wearer to the crotch. It has been found that for body-type garments, the width of the strip should generally be between 12 inches and 30 inches and preferably between 14 inches and 24 inches. The length of the strip depends on the size and length of the desired garment.

Figure 5:
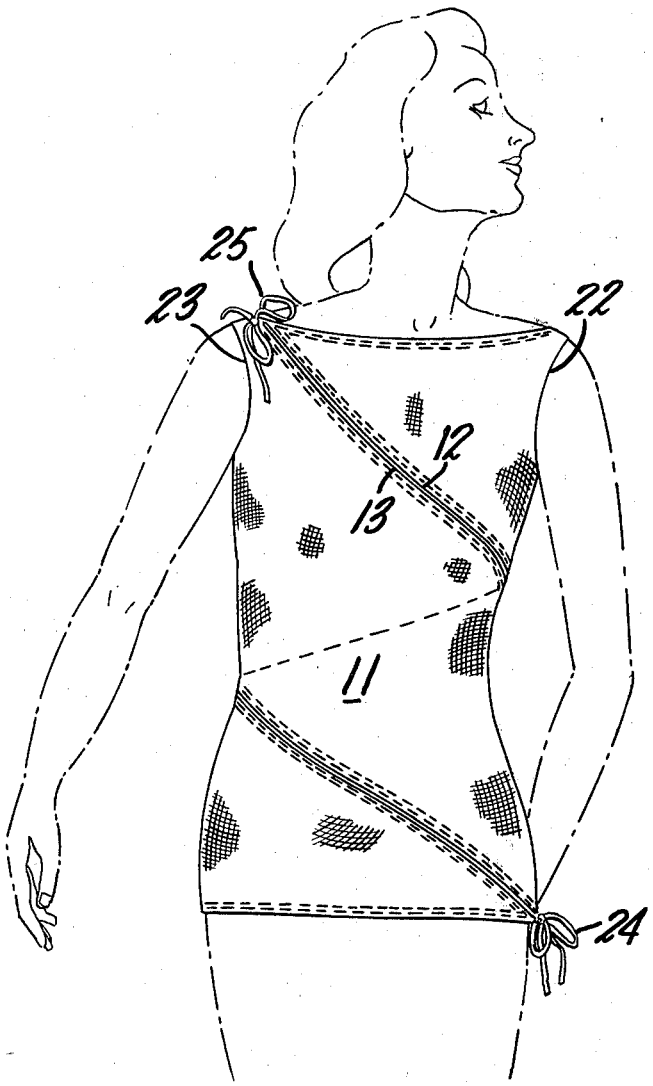
FIG. 5 shows a body-type garment which may for example be a blouse or sweater.
Figure 6:
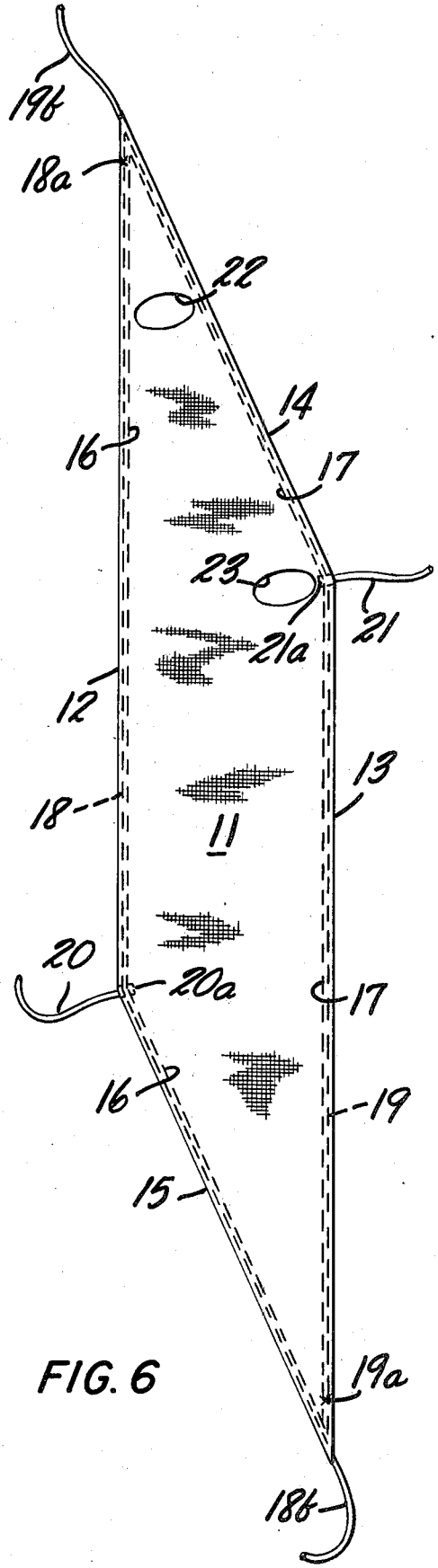
FIG. 6 shows a strip of material from which the garment of FIG. 5 is made.

In FIG. 5 there is shown schematically another body-type garment made in accordance with the invention while FIG. 6 shows the single piece of material from which the garment is made. It will be seen that the garment is of a type suitable to be worn as a shirt or blouse with a skirt or slacks. However, it could be made longer so as to be worn as a complete dress or as a slip.

The material of which the garment is made, as illustrated in FIG. 6, comprises a strip 11 having side edges 12 and 13 and end edges 14 and 15. The upper end edge 14 makes an acute angle with side edge 12 and an obtuse angle with side edge 13. The lower end edge 15 makes an obtuse angle with side edge 12 and an acute angle with side edge 13. A string passage 16 shown as a hem extends along side edge 12 and also along bottom edge 15. A second string passage 17 extends along side edge 13 and upper edge 14. A string 18 which extends through the string passage 16 has an upper end portion 18a secured to the material 11 while an end portion 18b extends out of the passage at the intersection of bottom edge 15 and side edge 13. A second string 19 which extends through string passage 17 has a lower end 19a secured to the material and an end portion 19b which extends out of the passage 17 at the intersection of side edge 12 and upper end edge 14. A tie string 20 is secured to the material at 20a at the intersection of side edge 12 and lower end edge 15. A second tie string 21 has an end secured to the material at 21a at the intersection of side edge 13 and upper end edge 14. Near the upper end edge 14 the strip is provided with openings 22 and 23 which are to form armholes of the garment.

When the garment is worn the strip 11 is wound helically around the body as illustrated in FIG. 5 so that the side edge 12 is adjacent the side edge 13. The string 18 in the string passage 16 is pulled taut by the extending end 18b and the end 18b is tied to the tie string 20, for example in a bow knot 24. Likewise the string 19 in string passage 17 is pulled taut by the extending end portion 19b which is thereupon tied to the tie string 21, for example in a bow knot 25. The strings 18 and 19 thereby keep the side edges of adjacent convolutions of the strip adjacent one another. The upper edge 14 forms the neckline of the garment. The lower end edge 15 forms the lower edge of the garment. The openings 22 and 23 form armholes. While the garment is illustrated as being sleeveless, it will be understood that sleeves may be inserted in the armholes if desired.

Various options described above in connection with FIGS. 1 and 2 with respect to the material and constructions of the strip and the nature of the strings apply also to the garment illustrated in FIG. 5.

Figure 7:
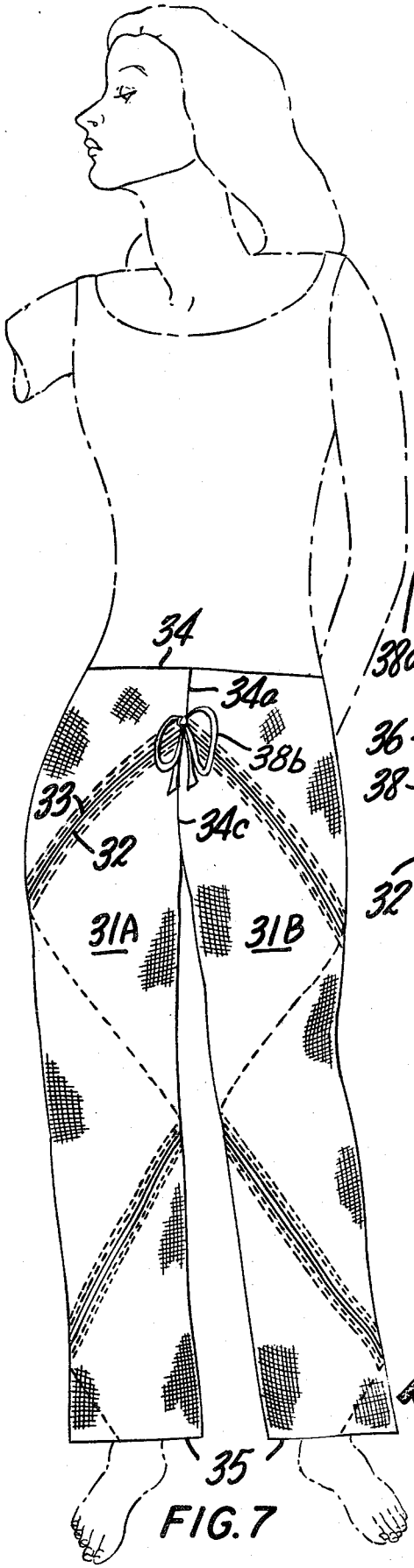
FIG. 7 shows a pants-type garment.
Figure 8:
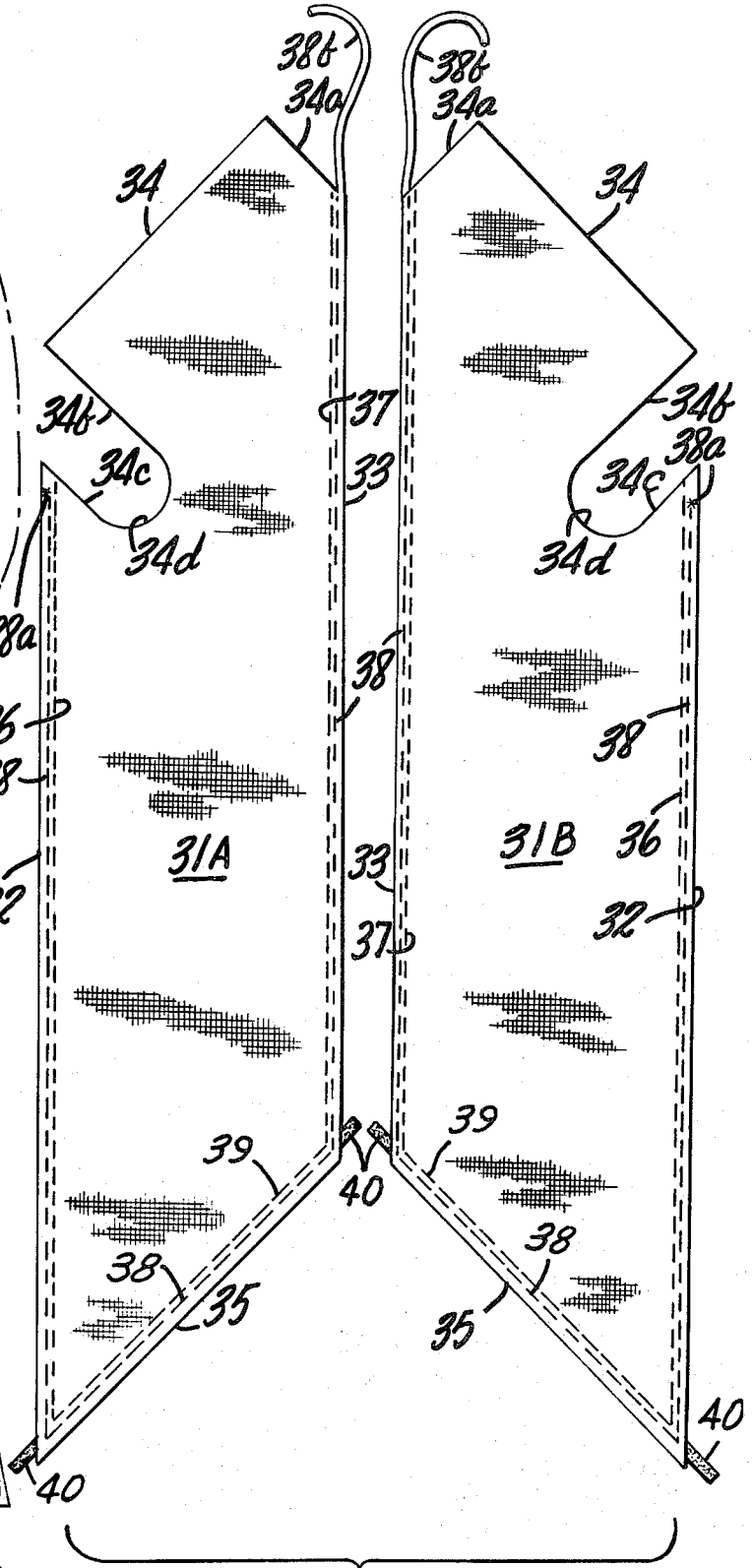
FIG. 8 shows the two strips of material from which the garment of FIG. 7 is made.

In FIG. 7 there is shown schematically a pants-type garment made in accordance with the present invention while FIG. 8 shows the material of which the garment is made. The garment is shown as comprising a body portion which covers the lower portion of the torso and two leg portions which extend downwardly from the body portion.

The garment shown in FIG. 7 is made of two strips of material 31A and 31B as illustrated in FIG. 8. The two strips are alike except that one is the mirror image of the other. Each of the strips has side edges 32 and 33 and upper end edge 34 and a lower end edge 35. The end edges are inclined with respect to the side edges so as to define at least approximately a parallelogram shape. The upper end edge 34 forms an obtuse angle with the side edge 32 and an acute angle with the side edge 33. The lower end edge 35 forms an acute angle with the side edge 32 and an obtuse angle with the side edge 33. At the upper end of each strip there is a shorter edge 34*a* which is approximately perpendicular to the end edge 34. Moreover, in the side edge 32 just below the end edge 34 there is provided a cutout having approximately parallel edges 34*b* and 34*c* joined by an arc 34*d*. The edges 34*b* and 34*c* are approximately perpendicular to the end edge 34.

Along the side edge 32 there is provided a string passage 36, for example in the nature of a hem. A similar string passage 37 is provided along the opposite side edge 33. A string passage 39 along the lower edge 35 connects the lower ends of passages 36 and 37. A string 38 has one end attached at 38*a* at the upper end of string passage 36 extends downwardly through string passage 36 to the lower end of the passage. It then extends through passage 39 to the lower end passage 37 and up through the passage 37. An end portion 38*b* extends out beyond the upper end of the string passage 37. Suitable fastening means is provided for connecting portions at the intersection of bottom edge 35 with side edges 32 and 33 respectively. While these portions can be attached for example by sewing, it is considered preferable to use separable fastening means such as a snap, hook and eye or a Velcro fastener 40 as illustrated schematically in the drawings.

When the garment is assembled, the two strips 31A and 31B are coiled helically as illustrated in FIG. 7 so that helically coiled strip 31A forms one leg of the garment while helically coiled strip 31B forms the other leg. Upper portions of the strips 31A and 31B are joined to form the body portion of the garment. Thus edges 34*a*, 34*b*, 34*c* and 34*d* of strip 31A are joined respectively with edges 34*a*, 34*b*, 34*c* and 34*d* of strip 31B, for example by sewing. A zipper or other form of closure may be provided at the front, back or side of the garment. Edges 34 of strips 34A and 34B form the upper edge of the garment and may be suitably finished, for example by a waistband. By means of the fastener 40 the opposite ends of the bottom edge 35 are secured together. When the garment is worn the strings 38 are pulled taut by their extending ends 38*b* and are tied together for example by a bow knot as illustrated in FIG. 7. The garment is reversible so that the bow may, if desired, be at the back. The strings 38 hold the side edges of adjacent convolutions of the strips adjacent one another. It will be understood that the options described above as to the material in construction of the strips and the nature of the strings apply also to the garment illustrated in FIG. 7. The legs of the garment formed by the spirally coiled strips 31A and 31B may be made of any size or length to provide different styles or types of garments such as slacks, shorts and culottes.

Because of the diameter of the leg being smaller than that of the body portion, the width of the strips used for the legs is preferably somewhat less than that of the strip for the body in order to have approximately the same angle of inclination. For example the strips used for the legs may have a width of about 6 inches to 20 inches and preferably about 8 inches to 16 inches. For childrens sizes the strips used may be narrower. For example the body portion of a childs garment may be formed of a strip which is between 6 inches and 18 inches wide and preferably between 8 inches and 12 inches wide. Leg portions of childs pants-type garments may be made of strips having a width of 4 inches to 12 inches and preferably 6 inches to 10 inches.

While preferred embodiments of the invention have been illustrated in the drawings and are herein particularly described, it will be understood that the construction in accordance with the present invention is susceptible of many modifications and variations and that the invention is thus in no way limited to the illustrated embodiments.

What is claimed is:

1. A body-type garment comprising a strip of material having side edges and inclined upper and lower end edges defining at least approximately a parallelogram shape, string passages extending at least along said side edges, said strip being coiled into helical form with side edges of adjacent convolutions adjacent one another, string extending through said string passages and means for drawing said string taut and securing it to hold said side edges of adjacent convolutions adjacent one another.

2. A body-type garment according to claim 1, further comprising a crotch piece attached at spaced locations to the lower end edge of said strip and adapted to form a crotch of said garment.

3. A body-type garment according to claim 2, in which said string passes through said string passage at one side edge of said strip from the upper end edge to the lower end edge and then through said string passage at the opposite side edge of said strip from the lower end edge to the upper end edge, said string drawing and securing means comprising upper end portions of said string which extend out from said string passage whereby they can be pulled and tied together.

4. A body-type garment according to claim 1, in which said strip comprises tubular fabric which is flattened so as to form folds at opposite side edges of said strip, said folds providing said string passages.

5. A body-type garment according to claim 1, in which said string passages comprise hems at the side edges of said strip.

6. A body-type garment according to claim 1, in which said string passages comprise a first string passage that extends along one side edge and one end edge of said strip and a second string passage that extends along the other side edge and the other end edge of said strip.

7. A body-type garment according to claim 1, in which said upper end edge of said strip forms an acute angle with a first side edge and an obtuse angle with a second side edge of said strip while said lower end edge forms an obtuse angle with said first side edge and an acute angle with said second side edge, and in which a first string passage extends along said first side edge and said lower end edge while a second string passage extends along said second side edge and said upper end edge.

8. A body-type garment according to claim 7, in which a first tie string affixed to said strip at the junction of said first side edge and said lower end edge is tied to a projecting lower end of a first drawstring extending through said first string passage and secured to said strip near the intersection of said first side edge with said upper end edge of the strip, while a second tie string affixed to said strip at the junction of said second side edge with said upper end edge is tied to a projecting upper end of a second drawstring extending through said second string passage and secured to said strip near the intersection of said second side edge with said lower end edge of the strips.

9. A pants-type garment comprising a body portion and two leg portions extending down from said body portion, each of said leg portions and an associated portion of said body portion comprising a strip of material having side edges and inclined upper and lower end edges defining at least approximately a parallelogram, first, second and third string passages extending respectively along one of said side edges, said lower edge and the other of said side edges of said strip, said strip being coiled into helical form with side edges of adjacent convolutions adjacent one another, string extending through said string passages, and means for drawing said string taut and securing it to hold said side edges adjacent one another, upper portions of said strips forming the two legs being shaped and joined to form said body portion of the garment.

10. A pants-type garment according to claim 9, in which said upper end edge of each of said strips forms an obtuse angle to a first side edge and an acute angle to a second side edge while said lower end edge of each of said strips forms an acute angle with said first side edge and an obtuse angle with said second side edge, and in which said string comprises a string which is secured to each said strip near the intersection of said first side edge and said upper end edge, extend down through said first string passage along said first side and to the lower end of said first string passage, through said second string passage into said third string passage at its lower end, and up through said third string passage along said second side edge of the strip, an upper end portion of said string extending out of the upper end of said third string passage and being tied to a projecting upper end portion of a like string of the other strip.

11. A pants-type garment according to claim 10, further comprising means for securing opposite extremities of said lower edge together.

* * * * *